US006848582B2

(12) United States Patent
Manola

(10) Patent No.: US 6,848,582 B2
(45) Date of Patent: Feb. 1, 2005

(54) LONGITUDINAL MICROMETRIC SEPARATOR FOR CLASSIFYING SOLID PARTICULATE MATERIALS

(75) Inventor: Umberto Manola, Brescia (IT)

(73) Assignee: DDS Technologies USA, Inc., Boca Raton, FL (US)

( * ) Notice: Subject to any disclaimer, the term of this patent is extended or adjusted under 35 U.S.C. 154(b) by 143 days.

(21) Appl. No.: 10/281,911

(22) Filed: Oct. 28, 2002

(65) Prior Publication Data

US 2003/0221997 A1 Dec. 4, 2003

(30) Foreign Application Priority Data

May 28, 2002 (EP) ..... 02425336

(51) Int. Cl.[7] ..... B07C 5/38

(52) U.S. Cl. ..... 209/635; 209/629; 209/133; 209/135; 209/146; 209/725; 209/730

(58) Field of Search ..... 209/635, 629, 209/133, 135, 134, 146, 149, 159, 725, 726, 730

(56) References Cited

U.S. PATENT DOCUMENTS 3,269,532 A * 8/1966 Moore ..... 209/33
3,836,085 A * 9/1974 Brown ..... 241/19
3,856,217 A * 12/1974 Brewer ..... 241/79.1
4,242,197 A * 12/1980 Voelskow et al. ..... 209/3
4,394,256 A * 7/1983 Goff ..... 209/135
4,853,112 A * 8/1989 Brown ..... 209/142
5,441,443 A * 8/1995 Roberts ..... 451/91
6,068,772 A * 5/2000 Czerwoniak et al. .... 210/512.3

FOREIGN PATENT DOCUMENTS

EP 0128392 A 12/1984
EP 0161327 A 11/1985
FR 332894 A 6/1903

OTHER PUBLICATIONS

European Search Report dated Oct. 25, 2002—Application No. EP 02 42 5336.1.

* cited by examiner

*Primary Examiner*—Donald P. Walsh
*Assistant Examiner*—Jonathan R Miller
(74) *Attorney, Agent, or Firm*—Greenberg Traurig, P.A.; Manuel Valcarcel, Esq.

(57) ABSTRACT

A longitudinal micrometric separator for the classification of solid particulate materials comprising an outer casing having an inflow opening and an outflow opening for the particulate material, a collection chamber at the bottom, as well as a sliding support for the particulate material extending substantially along a longitudinal drawing axis, in which the material is conveyed in the direction of the aforesaid longitudinal axis by a forced fluid flow. The sliding support comprises at least one first inclined wall, lying in a plane parallel to the drawing axis, and at least one dropping channel with axis parallel to the drawing axis and connected to a side end of the same inclined wall, the other side end of the inclined wall being set at a distance from the internal surfaces of the casing.

28 Claims, 5 Drawing Sheets

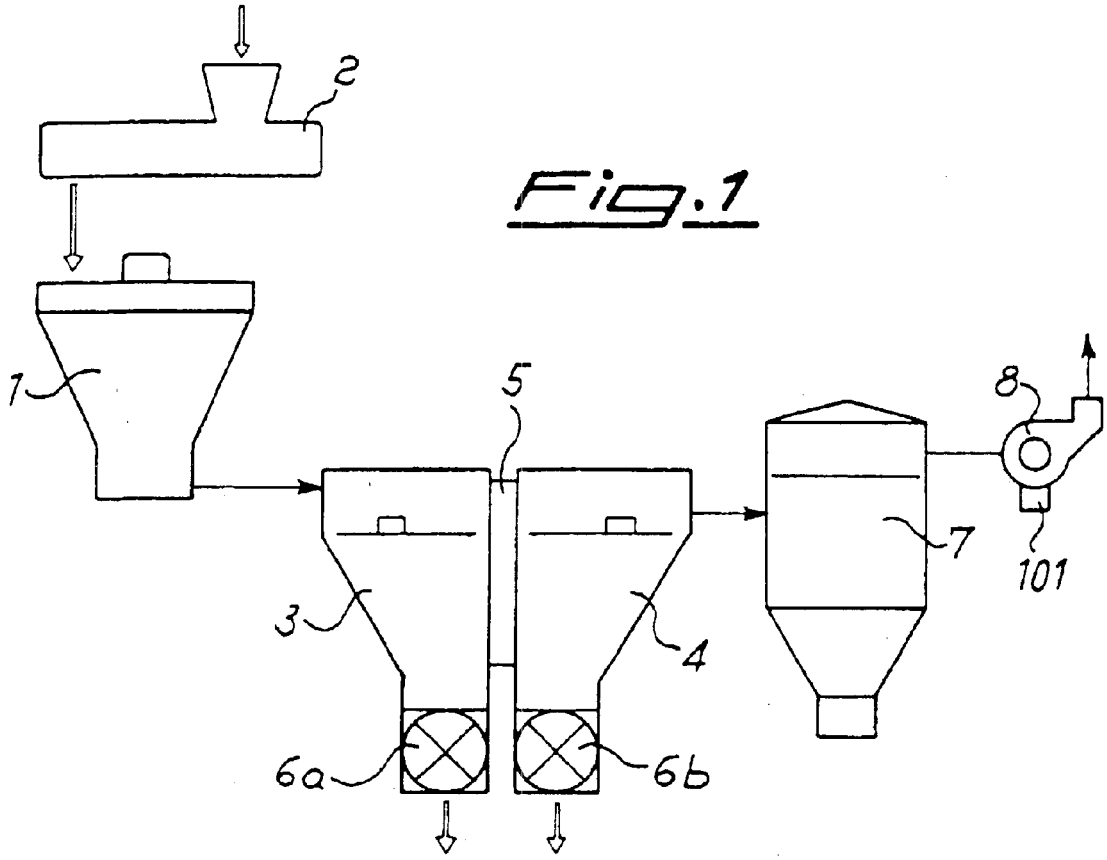
Fig.1
Fig.7
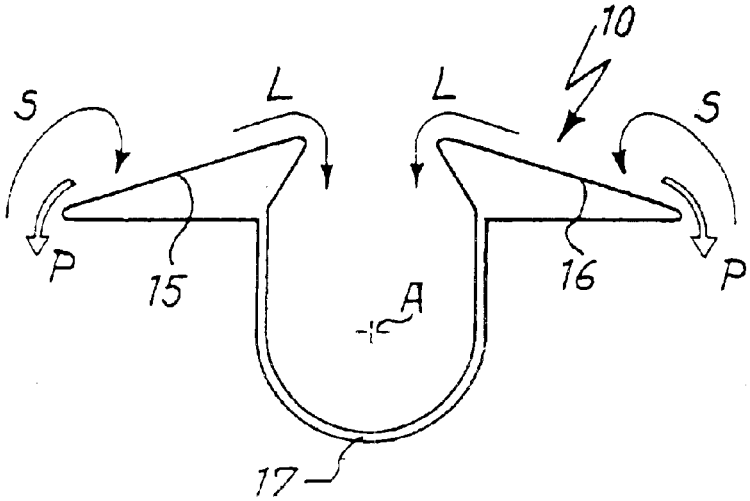

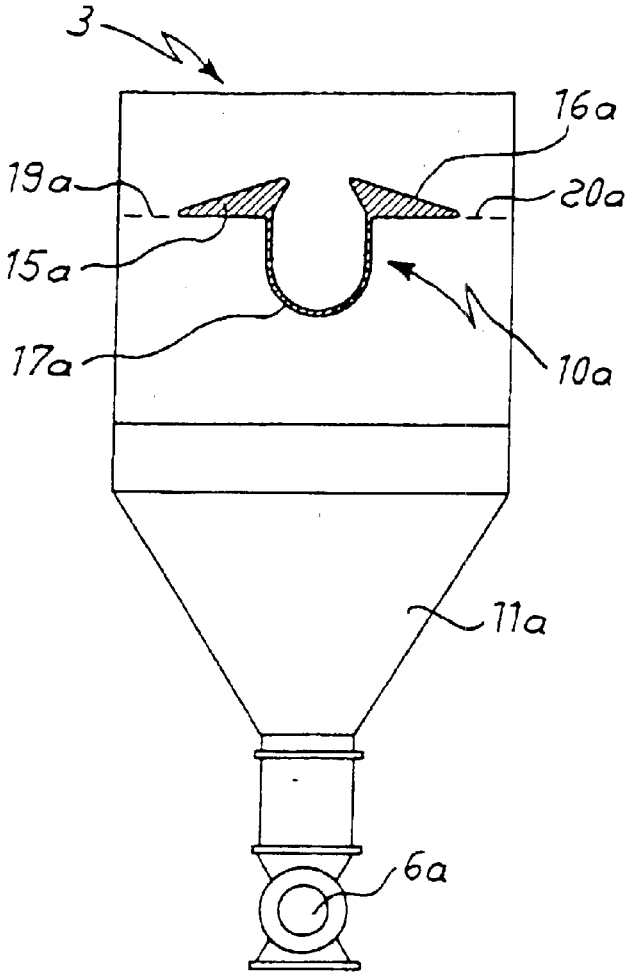
Fig. 3
Fig. 4
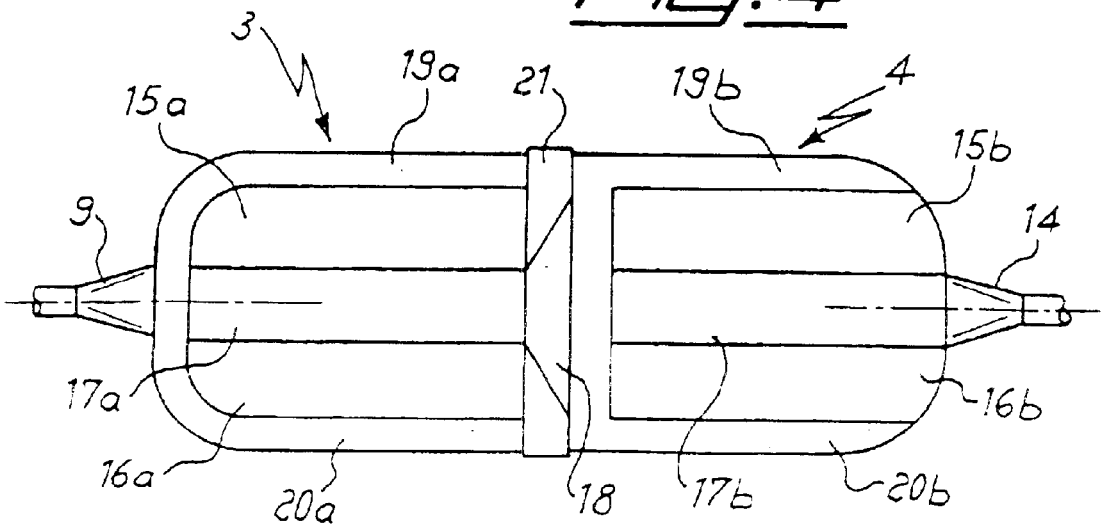

Fig. 5
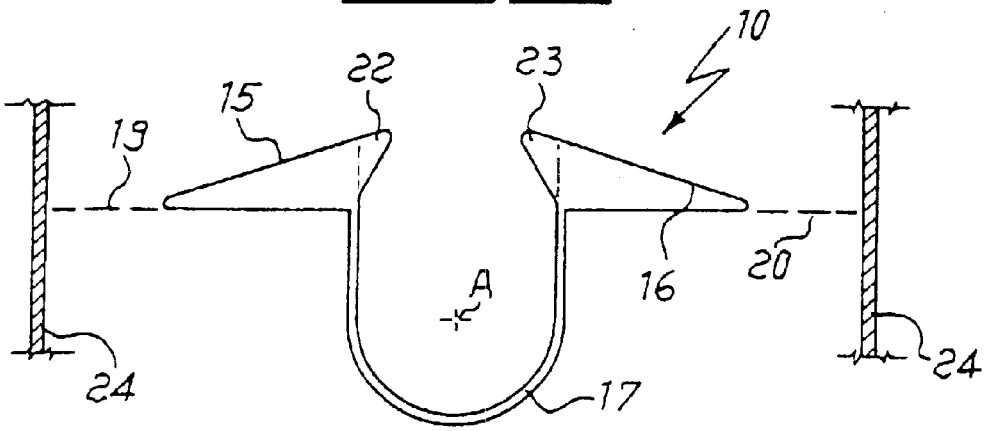
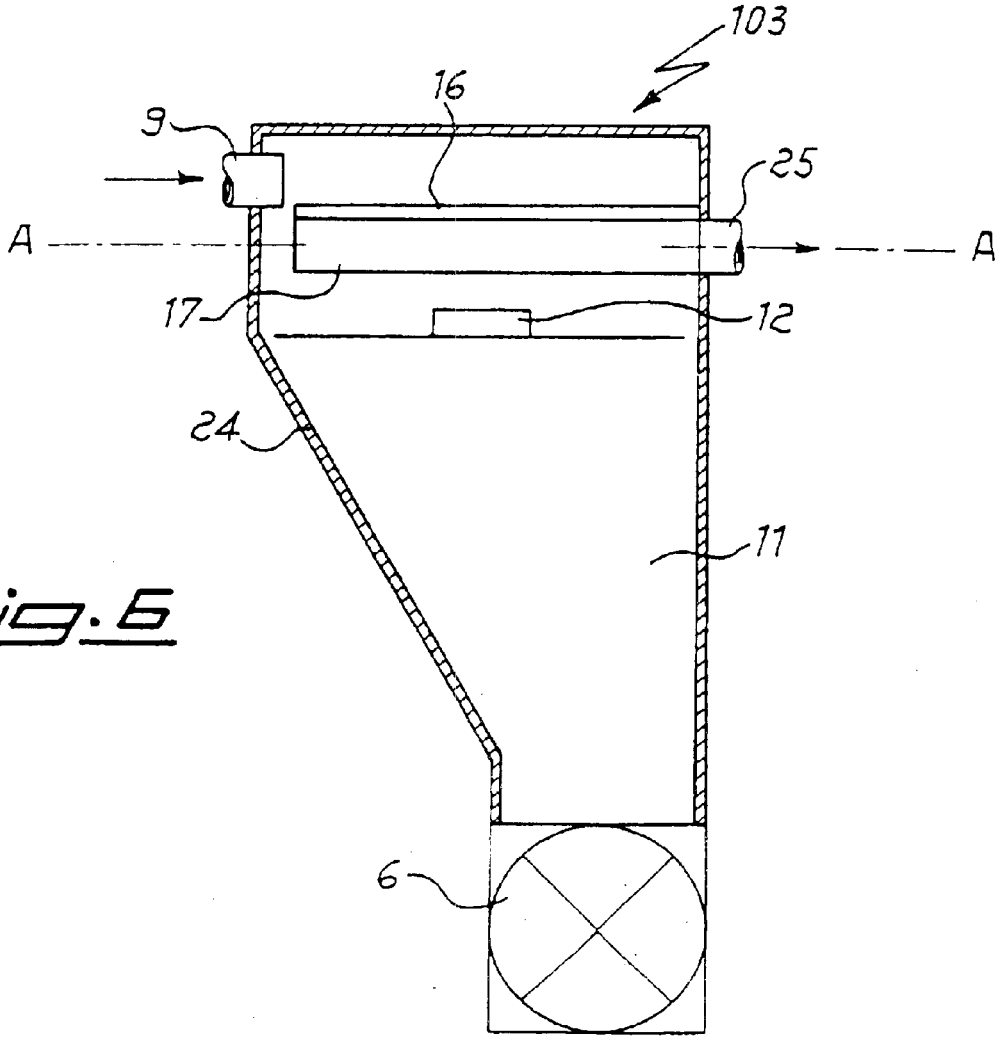
Fig. 6

LONGITUDINAL MICROMETRIC SEPARATOR FOR CLASSIFYING SOLID PARTICULATE MATERIALS

BACKGROUND OF THE INVENTION

1. Field of the Invention

The present invention relates to a micrometric separator for the classification of mixtures of solid particulate materials, in which a flow of fluid, preferably air, has the function of conveying the particulate material, inducing it to slide along appropriate retainer walls in such a way that, on account of the different physical properties of the particles, there occurs a separation thereof according to particle size. This particle-size separation (i.e. the granulometric separation) is of particular importance in the field of organic substances in powder form, because it enables mixtures of materials to be obtained with a specific particle-size (granulometry), having organoleptic characteristics that can be decided a priori in the course of classification. Also in the context of the mixtures of inorganic materials, the separation of mixtures with homogeneous particle-size is of great importance, for example in the field of materials for the building sector.

2. Discussion of Related Art

Among the various types of micrometric classifiers, pneumatic separators, i.e., ones with forced fluid flow for the drawing-along (entrainment) of the material, are commonly used, both on account of their efficiency, and on account of the relative simplicity of use. In the context of the above-mentioned pneumatic separators, classifiers of particulate material are known that are made up of a plurality of cyclone devices set in series, in which the mixture of materials is introduced into a container having the shape of a truncated cone with a vertical axis (cyclone), usually in a direction tangential to the side walls of the latter, so as to obtain a centrifugal vortical flow of the material to be separated. The particles, which are induced, in their circular motion, to slide along the side walls of the container, are thus substantially subject to the centrifugal force resulting from the flow of conveying air, to the force of friction, in a direction opposite to the centrifugal force, which develops in the interaction of the material with the walls of the container themselves, and to the force of gravity. Inside the cyclone there is also present an ascending flow of air, which develops at the vertical axis of the cyclone itself.

The different kinetic energy which, by virtue of the above-mentioned forces, particles with different density and particle-size possess, brings about a separation of the material within the cyclone. The particles of large weight tend to drop along the walls and to deposit in a collection hopper. The collection hopper is set at the base of the container, which has the shape of a truncated cone. Finer particles, which are of small weight, tend to be drawn by the forced flow of air towards an outlet pipe, which is usually axial, of the cyclone itself. The geometry of the container having the shape of a truncated cone and the amount of flow of drawing air determine separation of particles that are of different particle-sizes (i.e. granulometry). Hence, by using in series cyclones presenting different characteristics and possibly varying the characteristics of the flow, a progressive classification of the particles is obtained.

The above separators, albeit of simple construction, are of large overall dimensions, tend to be very subject to wear, and prove far from sensitive to the finer granulometry of the material.

With the aim of increasing the efficiency of classification of centrifugal separators (cyclone separators) with tangential introduction of particulate matter, there have been proposed centrifugal-separation devices, in which the particulate material is introduced axially into a cylindrical container with a vertical axis so as to deposit on a disk, which is appropriately shaped and perforated and which is separated by gaps from the walls of the cylinder and is traversed by a forced flow of air. The kinetic energy exerted on the particles and the paths along which the latter are forced to move determine the separation of particulate matter of different size.

The above type of pneumatic separator, which is for example described in the patent No. EP 0.128.392 B1 in the name of the present applicant, achieves a high efficiency of separation, but is structurally complex and of difficult construction. In addition, it may be subject to wear and to jamming of the material to be classified.

A purpose of the present invention is to provide a separator for the classification of solid particulate materials which is extremely efficient as regards granulometric separation and at the same time is of simple construction.

Another purpose of the present invention is to provide a classifying separator for particulate matter that is not subject to jamming of the material during use and which can be regulated simply and precisely.

A purpose of the present invention is also to obtain a system or plant for the classification of solid particulate materials that is of simple construction, of high sensitivity to the finer particle-sizes (granulometry) of the particulate and affords ease of maintenance. A further purpose of the present invention is to provide a method for the separation of particulate materials that is particularly easy to implement and that presents a great effectiveness of classification.

The above and other purposes are achieved by the micrometric separator for the separation of solid particulate materials, by the system for the separation of solid particulate materials and by the method according to the present invention.

SUMMARY OF THE INVENTION

The micrometric separator for classification of solid particulate materials according to the present invention, comprises an outer casing having an inflow opening and an outflow opening for the material to be separated, conveyed by a forced fluid flow, a collection chamber at the bottom, having for example a rotary valve for the discharge of the material, as well as a sliding support for the particulate material.

The sliding support extends substantially along the longitudinal axis of drawing (entrainment) of the material and comprises at least one first inclined wall, lying in a plane parallel to the axis of drawing, and at least one dropping (fall) channel with axis parallel to the axis of drawing and connected to a side end of the same inclined wall. The other side end of the first inclined wall is set at a distance from the internal walls of the casing to form a gap for connection to the collection chamber.

According to a preferential feature of the present invention, the micrometric separator is equipped with a second inclined wall, which lies in a plane parallel to the axis of drawing and is incident to the first wall. The second inclined wall is moreover separated from the first inclined wall by the aforesaid dropping channel. The dropping channel is connected to at least one of the first inclined wall and the second wall at a top side end of the at least one of the first and inclined walls. In particular, the dropping channel is connected, on opposite sides, respectively, to a side end of the first inclined wall and to a side end of the second inclined wall. The Other side ends of the first and second inclined walls are set at an appropriate distance from the internal surfaces of the casing to form at least two gaps (i.e. air spaces) of connection to the collection chamber at the bottom.

In a preferred embodiment of the separator according to the present invention, the casing of the separator comprises one or more side mouths for intake of secondary air, which will lap the sliding support. The said side mouths can be controlled by appropriate flow regulators. The system for the separation of solid particulate materials according to the present invention, comprises at least one micronization device operatively connected upstream of one or more classifying separators of the type described above.

In a preferred embodiment of the system according to present invention, this comprises a plurality of separators of the type described set in series, and means for the generation of a forced flow of air, in suction or compression.

BRIEF DESCRIPTION OF THE DRAWING

Described in what follows are some preferred embodiments of the present invention, provided purely by way of non-limiting example, with reference to the attached figures, in which:

FIG. 1 is a schematic overall view of a system for the classification of solid particulate materials according to a particular feature of the present invention;

FIG. 3 is a cross-sectional front view of one of the separators illustrated in FIG. 2;

FIG. 4 is a top view of the separators of FIG. 2;

FIG. 5 is a cross-sectional front view of a sliding support set inside a separator, according to a preferential embodiment of the present invention;

FIG. 6 is a schematic cross-sectional view of a separator according to a preferential aspect of the present invention;

FIG. 7 is a front representation of a sliding support according to present invention, on which there is indicated a working diagram of the separator;

DETAILED DESCRIPTION OF THE INVENTION

Figure 2:
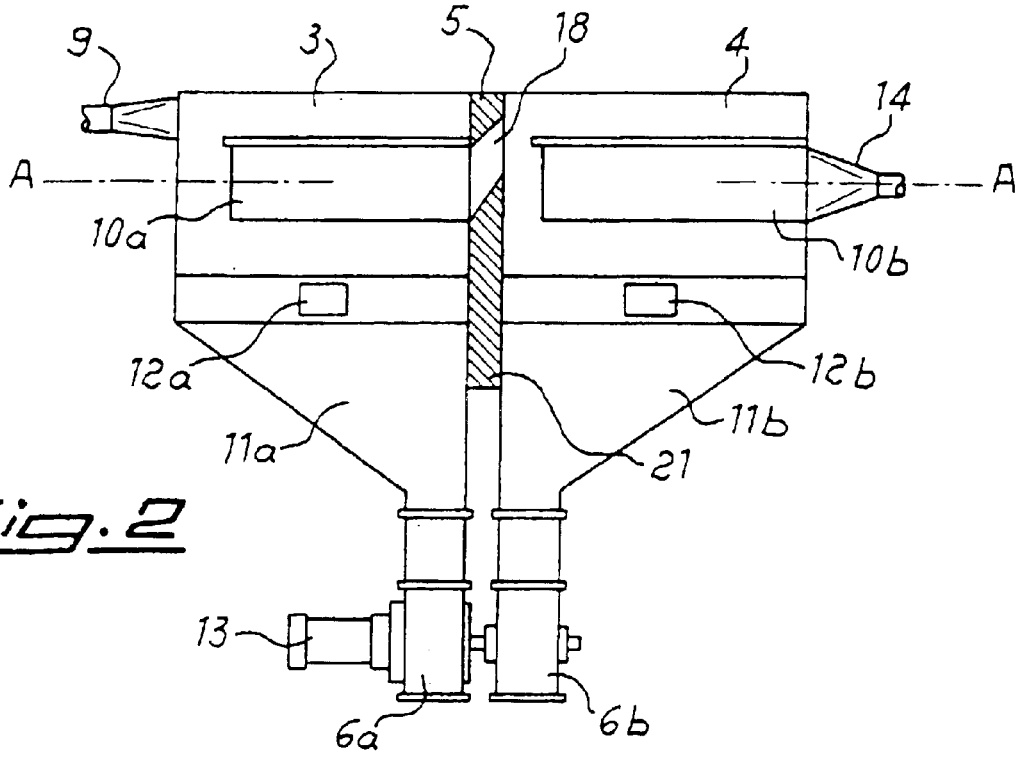
FIG. 2 is a cutaway side view of two separators, according to a preferential aspect of the present invention, set in series.

With reference, initially, to FIG. 1, the system for the separation of solid particulate materials, according to a preferential aspect of the present invention, comprises a micronizer 1 fed by a screw conveyor 2, two classifying separators 3, 4 set downstream of the micronizer 1 and in series with respect to one another, filtering means 7 connected to the outflow pipe of the separators 3, 4, and a suction device 8.

The two separators 3, 4 are set in reciprocal fluid communication thanks to a connector 5 and each have, in their bottom portion, a rotary discharge valve 6*a*, 6*b*, for example of the star type. The suction means 8 are moreover designed for generating a forced flow of air in suction and can be equipped with means 101 for regulating the air flow generated.

The material to be classified is thus sent, thanks to the feed screw-conveyor 2, to the micronizer 1, in which it is ground until it assumes the conformation of particulate matter. From the micronizer 1, the particulate matter is introduced into the battery of separators 3, 4, where, thanks to the forced air flow generated in suction by the device 8, it is drawn longitudinally through said separators 3, 4. During passage through the separators 3, 4, the material is separated according to its particle-size, thus obtaining, at output from the discharge valves 6*a*, 6*b*, mixtures of material of substantially homogeneous particle-size.

In particular, as will be clarified in what follows, from an analysis of the operation of the separators, on the discharge valve 6*a* there will be deposited material of larger particle-size, while on the valve 6*b* material of finer particle-size will be obtained.

The drawing air flow at output from the battery of separators 3, 4, is next introduced into the filtering means 7 and then, once purified, is discharged into the atmosphere downstream of the suction device 8.

The number of separators 3, 4, which are connected in series inside the system, can vary according to the product specifications, i.e., according to the different particle-sizes that it is intended to obtain from the system, and likewise the suction device 8 can be replaced also by a compressor set upstream of the separators 3, 4, without thereby modifying the capacity for separation of the system.

In other embodiments, the system can be equipped with traditional cyclone separators and longitudinal separators 3 or 4, and also the forced flow of fluid can be an inert gas (for example nitrogen).

With reference to FIGS. 5 and 6, there will now be described a separator 103, similar to the separators 3, 4 of FIG. 1, according to a preferential aspect of the present invention. The separator 103 comprises an outer casing 24 having an inflow opening 9 and an outflow opening 25, through which the particulate material passes, coming, for example, from a micronizer, transported by a forced flow of air in the direction of a longitudinal axis A—A in the direction indicated by the arrows of FIG. 6.

Present inside the casing 24 is a sliding support 10 for the particulate material, and a collection chamber 11, identified underneath the support 10, in connection with a rotary valve 6. In particular, the sliding support 10 extends in a direction parallel to the longitudinal drawing (i.e. entrainment) axis A—A, so as not to obstruct the forced flow of air, which transports the particulate material.

The casing 24 may likewise have side mouths—or orifices—12 for introduction of a secondary air flow, coming from the external environment to the casing 24, the said mouths 12 possibly being controlled by regulation devices for adjusting the intake flow (not illustrated).

As illustrated in greater detail in FIG. 5, the sliding support 10 comprises two inclined walls 15, 16, which lie in mutually incident planes parallel to the axis A—A of drawing. The two walls 15, 16 are separated from one another by a dropping channel 17 (or fall channel), which, in the embodiment illustrated, is connected, on opposite sides, to the two walls 15, 16, at their top side ends. The other ends, set at a lower height, of the two walls 15, 16, are instead set at a distance from the adjacent walls of the casing 24 by gaps (i.e. air spaces) 19 and 20, respectively. The gaps 19, 20 enable passage of the material from the walls 15, 16 to the collection chamber 11.

The longitudinal drawing axis A—A, which in the embodiment illustrated is horizontal, moreover passes substantially in a central position, inside the cavity defined by the channel 17, and more in particular the axis A—A is equidistant from both of the inclined walls 15, 16. This is obtained, in particular, by connecting the outflow opening 25 of the separator 103 with the dropping channel 17.

The support 10 is constrained to the casing 24 of the separator 103 by means of the engagement, for example by welding, of the rear section of the walls 15 and 16 with the casing 24 itself. In this way, the walls 15 and 16 are not geometrically connected to the outflow opening 25, and only the material that has dropped into the channel 17 can leave the separator 103 through the opening 25.

In the particular embodiment illustrated in FIG. 5, the inclined walls 15, 16 have, at their ends engaged with the channel 17, portions 22, 23 which extend towards one another beyond the edge of the channel 17 itself. As will be seen, this has the function of preventing the material that has precipitated into the channel 17 from being, on account of vortices, again pushed against the top surfaces of the walls 15, 16.

The support 10 can be made of die-cast metal section, and the top surfaces, or deposition surfaces, of the inclined walls 15, 16 can advantageously undergo polishing in order to guarantee a high surface finish that prevents faults or interruptions in the sliding of the material and hence enables optimal separation of the particulate matter.

FIGS. 2 to 4 are schematic illustrations of the set of separators 3, 4 of the system represented in FIG. 1. The set of separators 3, 4 has a pipe 9 for introduction of the fluid flow into the separator 3 and a pipe 14 for outlet of the flow from the separator 4. The two separators 3, 4 are moreover connected together by a connector 5, which, as may be seen in FIG. 4, comprises a partition panel 21 and a channel 18, which has the purpose of fluid connection of the outflow opening (not illustrated) of the separator set upstream 3 with the inflow opening (not illustrated) of the separator set downstream 4. Since, as described above, the outflow and inflow openings of the separators 3, 4 are located at different heights, the channel 18 faces upwards, as is evident from FIG. 2.

Inside each separator 3, 4 is set a support 10*a*, 10*b*, for sliding of the particulate material, the said support extending parallel to the direction A—A of drawing of the forced air flow. Underneath the support there opens a collection chamber 11*a*, 11*b*, which in turn converges towards a rotary valve 6*a*, 6*b*. The rotary valves 6*a*, 6*b* of the separators 3, 4 can be operated by one and the same motor 13.

The casing of the separators 3, 4 can be equipped with mouths 12*a*, 12*b* for introduction of a secondary air flow, taken from the external environment outside the casing, the said mouths 12*a*, 12*b* possibly being controlled by flow regulators (not illustrated).

Each support 10*a*, 10*b*, in a way similar to what has been described above in relation to FIGS. 5 and 6, comprises a first inclined wall 15*a*, 15*b*, which lies in a plane parallel to the longitudinal drawing axis A—A, a second inclined wall 16*a*, 16*b*, lying in a plane parallel to the drawing axis A—A, incident to the plane of the first inclined wall 15*a*, 15*b*, and a channel 17*a*, 17*b*, set between the two walls 15*a*, 16*a* and 15*b*, 16*b*. The channel 17*a*, 17*b*, in particular, is connected, on opposite sides, to the top side ends, i.e., at a higher level, of the walls 15*a*, 16*a* and 15*b*, 16*b*. The other side ends, at a lower level, of the walls 15*a*, 16*a*, 15*b*, 16*b* are set at a distance from the adjacent surfaces of the casing of the separator 3, 4, in such a way that between the entire support 10*a*, 10*b* and said internal surfaces of the separator 3, 4 there are two gaps 19*a*, 20*a* and 19*b*, 20*b*, through which the material can pass on its way to the collection chamber 11*a*, 11*b*.

Figure 8:
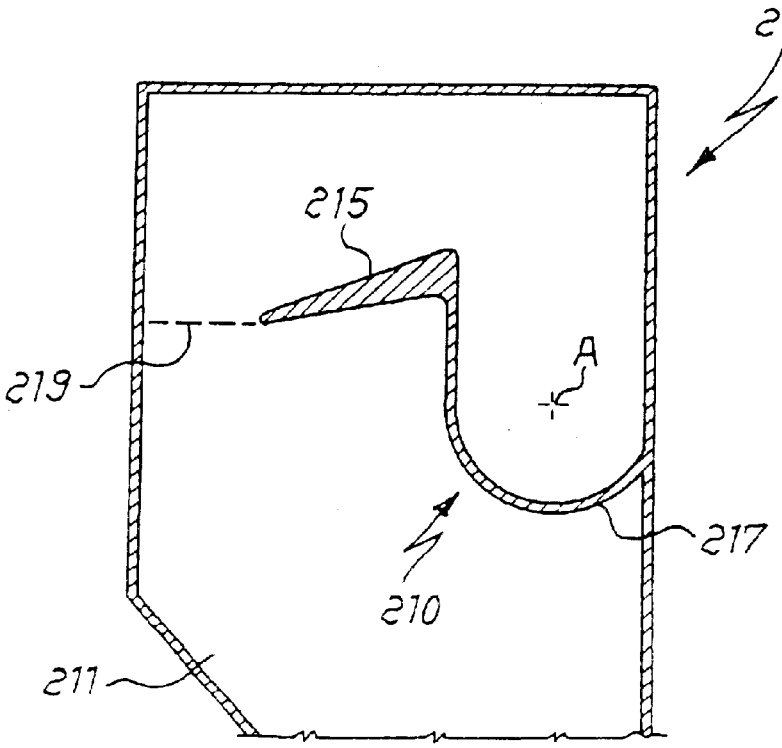
FIG. 8 is a partial cross-sectional front view of a further particular embodiment of the present invention.

In other embodiments, which are less efficient but of simple construction, such as the one illustrated in FIG. 8, the support 210, inside a separator 203, can comprise a single inclined wall 215, which has its top side end connected to a channel 217. The channel 217, in a way similar to the inclined wall 215, extends parallel to the longitudinal axis A—A of drawing of the forced fluid flow and joins an internal surface of the separator 203 with the inclined wall 215. The side end of the wall 215 that is not engaged with the channel 17 is moreover set at a distance from the adjacent internal surface of the separator 203 itself, so forming a gap 219 for connection to the collection chamber 211.

Operation of the separator according to present invention is described in what follows, with reference to FIGS. 1, 5, 6 and 7.

The particulate material is introduced, by means of the inflow opening 9, into the separator 103 and drawn by the flow of fluid generated by the suction device 8. In greater detail, from the opening 9, set above the support 10, the material deposits, on account of the suction current, on the top (deposition) surfaces of the walls 15, 16. Here, the particulate material is drawn so that it slides, in the longitudinal direction A—A, along the walls 15 and 16, where, owing to the inclination of the walls themselves and to the size of the suction flow, the particles having lower weight and particle-size (i.e. granulometry), also thanks to the central arrangement of the axis A—A of drawing of the fluid flow, tend to reach the top of the walls 15 and 16 and, from there, to drop, as is indicated by the arrows L, into the dropping channel 17. The arrangement of the axis A—A, inside the channel 17, favours the translation of the particles of finer particle-size towards the top edge of the walls 15, 16.

The particles of greater weight and larger particle-size, instead, tend to reach the edge at a lower height of the walls 15, 16 and, from there, to drop by gravity into the collection chamber 11 through the gaps 19, 20 that are present, as indicated by the arrows P.

As described above, since the walls 15, 16 are connected, in a longitudinal direction, to the casing 24, only the material of finer particle-size, which has dropped into the channel 17, can flow through the outflow opening 25, while the material of larger particle-size, which has dropped into the collection chamber 11, is discharged through the valve 6 in the bottom portion of the separator 103.

In the case where the separator 103 has mouths 12 for introduction of a secondary air flow, this secondary flow, drawn in from the external environment and having a direction substantially transverse to the longitudinal axis A—A, on account of the forced flow acting along A—A, generates vortices S (see FIG. 7), which can facilitate the classification of the particles, accelerating the process of dropping of the material that slides along the walls 15, 16 either towards the channel 17 or towards the collection chamber 11.

According to a preferred aspect of the present invention, should the system envisage a plurality of separators set in series, it may be immediately appreciated how it is possible to obtain easily a fractionated separation of increasingly finer particle-sizes as the separators set downstream of the micronizer are reached. In fact, the material of finer particle-size coming out of the outflow opening of a separator set upstream is introduced into a separator set downstream, where it undergoes a further refining and, from here, the material of even finer particle-size, can be introduced into a further separator, and so forth.

From what has been set forth above, it is clear that the variation of the fluid flow for conveying the material, the inclination of the inclined walls of the support, the presence or otherwise of the secondary air flow from the external environment, and also the structure of the separator all influence the capacity and effectiveness of classification of the separator and hence of the system as a whole.

In addition, the structural simplicity of the separators according to the present invention renders their construction not excessively difficult, and it has been noted that this leads to a reduced possibility of clogging of the material inside the separators, and hence a reduced need for maintenance.

Figure 9:
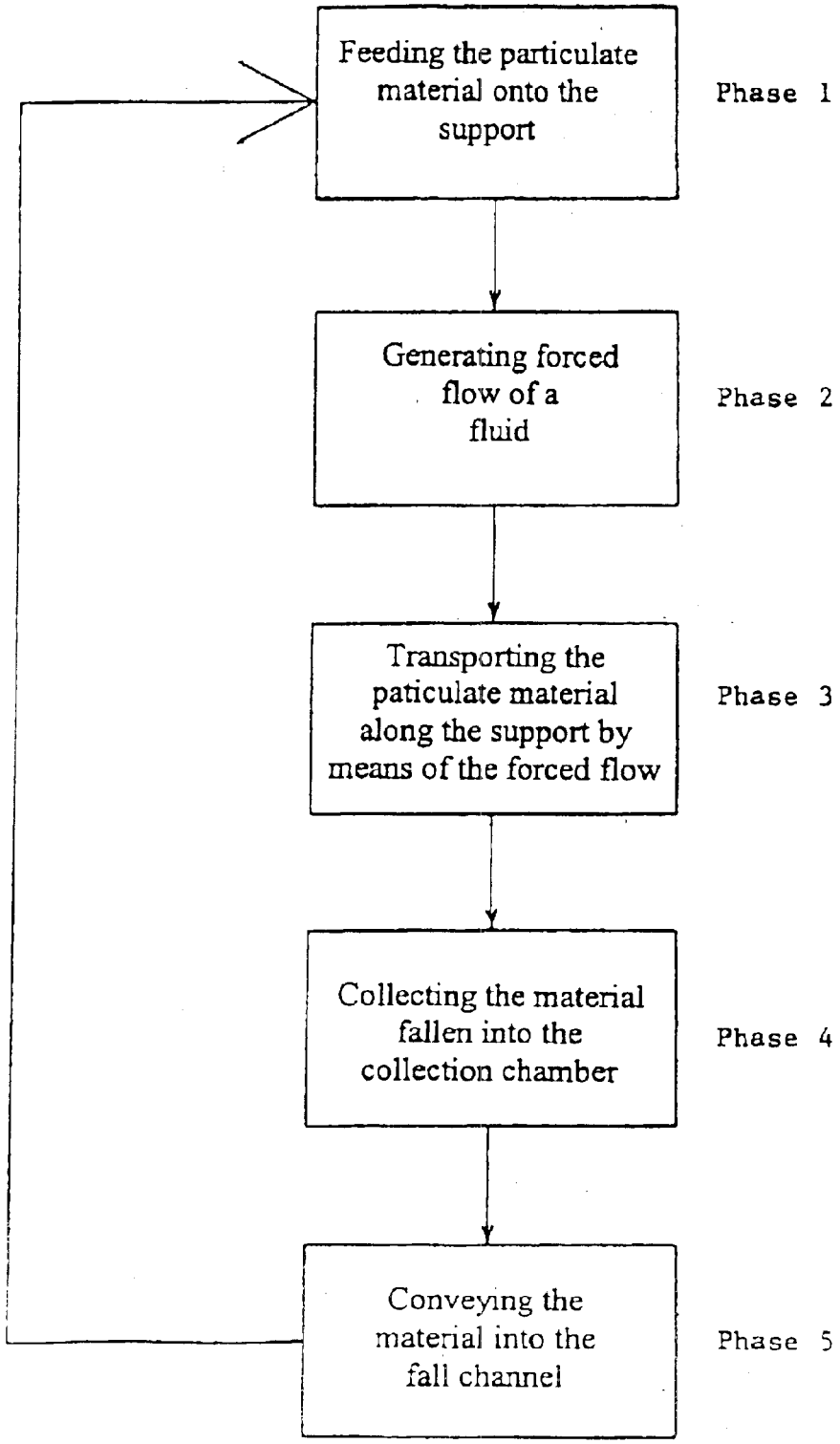
FIG. 9 is a block diagram, which presents a method for the separation of solid particulate materials, according to a preferential aspect of the present invention.

With reference now to FIG. 9, which describes by means of a block diagram a preferential method of separation according to the present invention, the steps envisaged for the separation of particulate materials of different particle-size, are the following:

step 1: the particulate material, mixture of particles having different size and weight, is deposited on a sliding support, such as the one described with reference to FIG. 5, extending along a longitudinal drawing axis A—A and having two inclined walls 15, 16, which are separated by a dropping (fall) channel 17 and connected, at their ends not engaged with the channel 17, to the collection chamber 11;

step 2: generating a forced flow of fluid directed substantially in the direction of the longitudinal axis A—A of the support 10;

step 3: drawing the particulate material along the support 10, thanks to the forced flow of fluid along the axis A—A;

step 4: collecting the material, with larger particle-size, deposited in the collection chamber 11.

The material deposited in the dropping channel 17, instead, can be directly collected, or else can undergo a further separation cycle (step 5) via repetition of the above-mentioned steps from 1 to 4. In a preferred embodiment of the method according to the present invention, the longitudinal drawing axis A—A extends substantially within the cavity defined by the dropping channel 17, and there may be provided secondary flows of fluid, which have a direction transverse to the drawing axis A—A, for generating lateral vortices, as described above in relation to the operation of the separator.

What is claimed is:

1. An apparatus for the classification of solid particulate materials, comprising a micrometric separator that includes an outer casing having an inflow opening and an outflow opening for the solid particulate materials, a collection chamber at a bottom of the outer casing, as well as a support for sliding of the solid particulate. materials, the support extending substantially along a longitudinal drawing axis and arranged so that said particulate material is conveyed in the direction of said longitudinal drawing axis by a forced fluid flow, said support comprising at least one first inclined wall, lying in a plane parallel to the longitudinal drawing axis, and at least one dropping channel with axis parallel to the longitudinal drawing axis and connected to a side end of the same inclined wall, the other side end of said at least one first inclined wall being set at a distance from internal surfaces of said casing.

2. The apparatus according to claim 1, in which said longitudinal axis is substantially horizontal.

3. The apparatus according to claim 1, in which said support comprises a second inclined wall, lying in a plane parallel to the longitudinal drawing axis incident to the plane of said first inclined wall, and separated from the latter by said dropping channel, the dropping channel being connected, on opposite sides, respectively to a side end of said first inclined wall and to a said end of said second inclined wall, the other side ends of said first and second inclined walls being set at a distance from the internal surfaces of said casing.

4. The apparatus according to claim 3, in which said dropping channel is connected to said first inclined wall at a top side end of the said first inclined wall.

5. The apparatus according to claim 3, in which said dropping channel is connected to at least one of said first inclined wall and said second inclined wall at a top side end of the at least one of said first and second inclined walls.

6. The apparatus according to claim 5, in which a top surface of at least one of said first and second inclined walls is polished.

7. The apparatus according to claim 6, in which a top surface of said first wall is polished.

8. The apparatus according to claim 3, in which an end of one of said first and second inclined walls is prolonged beyond an edge of the dropping channel to which said one of said first and second inclined walls is connected.

9. The apparatus according to claim 3, in which an end of one of said first and second inclined walls is prolonged beyond an edge of the dropping channel to which said one of said first and second inclined walls is connected.

10. The apparatus according to claim 1, in which said casing comprises one or more side mouths for the entry of secondary air into the separator.

11. The apparatus according to claim 1, in which said dropping channel has a portion substantially with a semi-circular cross section.

12. The apparatus according to claim 11, in which an end of said first inclined wall is prolonged beyond an edge of the dropping channel to which said first inclined wall is connected.

13. The apparatus according to claim 1, in which said fluid flow is a flow of air.

14. The apparatus according to claim 1, in which said longitudinal drawing axis passes inside a cavity defined by said dropping channel.

15. The apparatus according to claim 1, in which said outflow opening is fluidically connected to said dropping channel.

16. The apparatus according to claim 1, in which said inflow opening is set above at least one first inclined plane and that said outflow opening is sec at said dropping channel.

17. The apparatus according to claim 1, further comprising a plant for the separation of the solid particulate materials comprising, in series, at least one micronization device and one or more classifying separators, characterized in that at least one of said classifying separators is configured in accordance with said micrometer separator.

18. The apparatus according to claim 17, in which a further one of the classifying separators is configured in accordance with said micrometer separator.

19. The apparatus according to claim 17, in which said fluid flow is a flow of air, and characterized by means for generating the forced flow of air.

20. The apparatus according to claim 19, characterized by means for regulation of the forced flow of air.

21. The apparatus according to claim 1, in which an end of one of said first and second inclined walls is prolonged beyond an edge of the dropping channel to which said first inclined wall is connected.

22. A method for the separation of solid particulate materials, comprising the steps of:

setting the solid particulate materials on a support extending along a longitudinal drawing axis; the support comprising at least one first inclined wall lying in a plane parallel to the longitudinal axis and laterally connected at one end to a dropping channel whose axis is parallel to said longitudinal axis; the at least one inclined wall having an other side end being connected to a collection chamber;

generating a forced flow of fluid;

drawing the solid particulate materials along said support to deposit at least part of the solid particulate materials with a lager particle-size than others into the collection chamber by means of said forced flow of fluid in the direction of said longitudinal axis; and collecting the solid particulate materials that were deposited in said collection chamber.

23. The method according to claim 22, in which during the step of drawing, some of the solid particulate materials deposits in the dropping channel, characterized by subsequently collecting the solid particulate materials that deposited in the dropping channel.

24. The method according to claim 23, further comprising setting the solid partculate materials that was collected from the dropping channel on the support;

drawing the solid particulate materials that were collected from the dropping channel and set on the support to deposit at least a portion into the collection chamber by means of said forced flow of fluid in the direction of said longitudinal axis; and collecting the portion deposited in said collection chamber.

25. The method according to claim 22, in which the longitudinal axis is substantially horizontal.

26. The method according to claim 22, in which said support comprises a second inclined wall lying in a plane parallel to the drawing axis, incident to said first wall, and separated from the latter by said dropping channel, the dropping channel being connected, on opposite sides, respectively, to a side end of said first inclined wall and to a side end of said second inclined wall, further side ends of said first and second inclined walls being connected to said collection chamber.

27. The method according to claim 22, in which said longitudinal axis extends in a cavity defined by said dropping channel.

28. The method according to claim 22, characterized by simultaneously with the step of drawing the material along the support:

introducing one or more secondary flows of air having a direction substantially transverse to said longitudinal drawing axis.

* * * * *